US007273431B2

(12) United States Patent
DeVall

(10) Patent No.: US 7,273,431 B2
(45) Date of Patent: Sep. 25, 2007

(54) IMPACT MEASURING GAME BALL

(76) Inventor: Donald L. DeVall, 1082 Charles Ave., Morgantown, WV (US) 26505

( * ) Notice: Subject to any disclaimer, the term of this patent is extended or adjusted under 35 U.S.C. 154(b) by 0 days.

(21) Appl. No.: 11/333,464

(22) Filed: Jan. 17, 2006

(65) Prior Publication Data

US 2007/0167266 A1 Jul. 19, 2007

(51) Int. Cl.
*A63B 43/00* (2006.01)

(52) U.S. Cl. ..... 473/570

(58) Field of Classification Search ..... 273/108, 273/108.4; 473/569–570
See application file for complete search history.

(56) References Cited

U.S. PATENT DOCUMENTS 4,775,948 A 10/1988 Dial et al.
5,261,661 A 11/1993 Lemmon
5,288,069 A 2/1994 Matsumoto
5,316,293 A * 5/1994 Hamilton ..... 473/570
5,526,326 A 6/1996 Fekete et al.
5,761,096 A 6/1998 Zakutin
5,779,576 A 7/1998 Smith et al.
6,148,271 A * 11/2000 Marinelli ..... 702/141
6,582,330 B1 * 6/2003 Rehkemper et al. ..... 473/570
2003/0207718 A1 11/2003 Perimutter

* cited by examiner

*Primary Examiner*—Robert E. Pezzuto
*Assistant Examiner*—Alex F. R. P. Rada, II
(74) *Attorney, Agent, or Firm*—Gary J. Morris

(57) ABSTRACT

A game ball is instrumented with a transducer to measure the impact forces on the ball and/or the decelerations by the ball experienced during an attempted catch by a person. The impact forces on the ball are equal and opposite to the forces on the hands of a person catching the ball so that the ball may be used as a training apparatus to teach a person the proper technique to catch a ball. A preferred catching technique includes decelerating the approaching ball to rest by the hands such that the action time of the catch is increased and the resulting force on the hands and the ball is decreased. Wireless transmission of data from the ball is sent to a remote receiver in one embodiment.

20 Claims, 8 Drawing Sheets

IMPACT MEASURING GAME BALL

BACKGROUND OF THE INVENTION

1. Field of Invention

This invention relates to the training of sports players to properly catch a game ball. More specifically, the invention measures and records the impact force, deceleration, or action time as the ball is attempted to be caught in the hands of a player. The device may be used to train players to minimize the impact force and to increase the impact time of the ball with the player's hands, thus increasing the likelihood that the player will successfully learn desirable techniques of catching the ball.

2. Background

Players in American football must use their hands properly in order to consistently catch a football that approaches them through the air. Two keys to being able to successfully catch the ball are a player's ability to maintain focus on the ball as it approaches the player's hands and the ability of the hands to reduce the momentum of the ball to zero with respect to the hands through a carefully controlled gripping motion of the hands on the surface of the ball. Both of these keys to proper catching require repetitive practice and training.

As a player catches a football, the player must use a catching technique such that the player's body absorbs the both the linear momentum and angular momentum of the ball through the player's hands. As such, the action of catching a football is an application of a perfectly inelastic collision between two bodies (the ball and player) in classical physics. The football travels along a ballistic path as a player maneuvers to intercept the trajectory of the ball, ultimately catching the ball and bringing it to rest with respect to the velocity of the player. This part of catching of a football, an oblong, rotating mass with diameter larger than the players hands, is difficult to teach and requires effective practice and training in order to master the technique and develop "soft hands", a term used to describe players that have mastered the technique of absorbing the momentum from a moving football by minimizing the impact force the football imparts on the hands as the football is caught. In general, the larger the impact force experienced by the hands of the player attempting to catch the football, the more likely the ball will bounce away from the hands before a grip on the ball can be established, rendering the catch unsuccessful.

OBJECTS AND SUMMARY OF THE INVENTION

The present invention is a training apparatus to measure the maximum and average impact forces experienced by a football as it is caught by the hands of a player. The force on the player's hands is equal and opposite to the force experienced by the ball as it is caught. A display on the football or at a remote location provides feedback to the player and/or trainers of the player regarding the player's ability to most effectively reduce the impact force imparted on the hands of the player attempting to catch the ball. It is an object of the invention to record and display the impact force the ball experiences during an attempted catch of the ball, either if successful or unsuccessful. Another object of the invention is to record the deceleration of the ball during a catch attempt. By comparing the impact force of the ball for successful catches to unsuccessful catches the player can learn how to better handle the ball during the action of catching it. In general, for balls approaching the player with equal velocity, the smaller the impact force experienced by the ball during the catch, the higher the chance the player has of successfully completing the catch. The impact force of the ball may be reduced by increasing the time of the action of the catch, which is a critical technique to be learned by the player. It is another object of this invention, in another embodiment, to wirelessly transmit the impact data from the ball during the action of catching to a wireless remote receiver where the impact data may be recorded and displayed. It is another object of this invention to provide an illumination source on the surface of the ball to further assist in training the player catching the ball to maintain visual focus on the ball as it approaches and is caught.

DETAILED DESCRIPTION OF THE PREFERRED EMBODIMENTS

Figure 1:
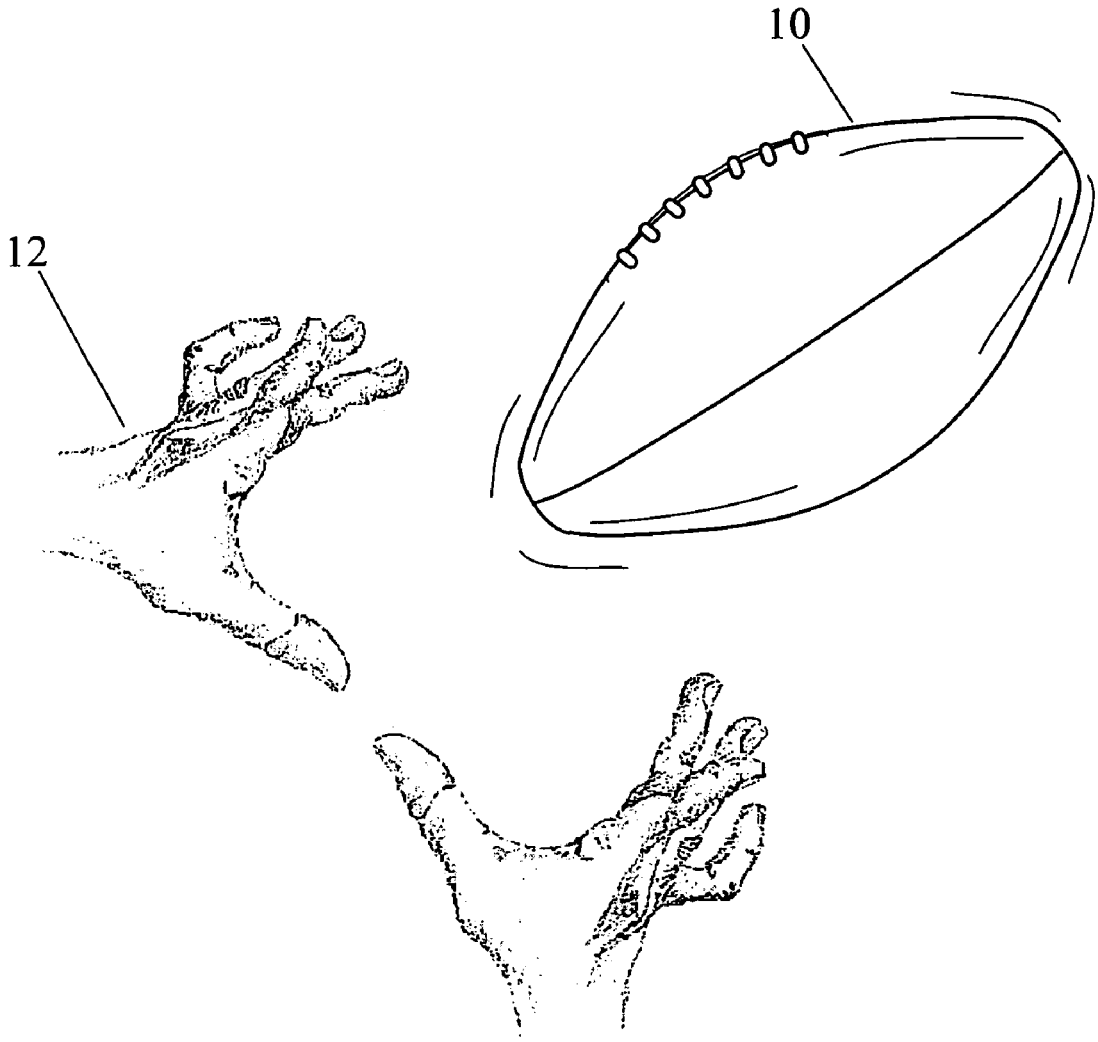
FIG. 1 shows a preferred embodiment of the exterior of the invention from a side view.

The Impact Measuring Game Ball is a ball used to train sports players how to most effectively catch a ball by minimizing the impact force experienced by the hands of the player and, by opposite reaction force, the force on the ball.

During the act of catching a ball, an equal and opposite impact force is exerted on the ball and on the hands of the player over a period of time. The integral of the force over the period of time is called the impulse, I, as given by the following equation:

$$I = \int_0^t F dt$$

where F equal the force on the ball as a function of time, t, during the catch.

Another way to express the impulse using the average impact force is as follows:

$$I=F_{average}\Delta t=m_{ball}\Delta V$$

where $F_{Average}$ is the average impact force experienced over the time of the catch, $\Delta t$, $m_{ball}$ is the mass of the ball, and $\Delta V$ is the change of velocity of the ball.

The velocity of approach of the ball with respect to the player can be approximated by noting:

$$F_{Average}\Delta t=m_{ball}a_{Average,\ ball}\Delta t=m_{ball}\Delta V$$

where $a_{Average,\ ball}$=the average acceleration of the ball during the catch attempt.

$$\Delta V=V_2-V_1$$

where $V_1$=the velocity of the ball approaching the player and $V_2$=the velocity of the ball after the catch which is zero.

Therefore, the velocity magnitude of the ball approaching the player is given by:

$$V_1=a_{Average,\ ball}\Delta t$$

The impulse required to catch a ball is fixed for a given mass and velocity of the ball, however, increasing time required to bring the ball to rest during the catch, reduces the average force experienced by the hands. Thus, for a given mass and velocity of the ball, the average force experienced by the ball during the catch is an accurate indicator of the relative duration of the catch. The longer the duration of the catch and the lower average force on the ball during the catch, the more likely the player will catch the ball and demonstrate a "soft hands" technique to catch the ball. The term "soft hands" here means the player's ability to catch a ball in his or her hand or hands using the technique of decelerating the ball to rest in a controlled way to minimize the average impact force between the ball and the hand(s) during the attempted catch. The degree of softness of a player's hand(s) is determined quantitatively by the ability of the player to minimize the impact force on the ball during the act of catching or to maximize the time of contact of the player's hand(s) with the ball during the act of catching, with the most important consideration of successfully completing the catch with the player in physical control of the ball in a smooth motion without bobbling the ball.

One parameter to quantify the proper technique of catching a ball is to compare the average force of impact experienced by the ball during the act of catching the ball by a player. For a ball having the same mass and velocity as it approaches a player, the lower the average impact force during the catch, the softer the hand(s) of the player. For successive catch attempts, the player receives feedback on his or her technique of catching the ball based on a relative comparison of the force of impact experienced by the ball during the catch attempt. The lower the force of impact is, the softer the hands of the player, which is an important factor in a successful catching technique.

Another parameter which is indicative of the softness of the player's hand(s) during a catch for a ball of fixed mass and velocity is the time of the action of the catch. The longer the time of the action of the catch, the lower the average impact force is for the catch. The time of action of the catch is defined as the time from first contact of the player's hands with the approaching ball to the time when the ball is at rest with respect to the player's hand(s).

Another important parameter is the velocity of approach of the ball towards the person. The velocity of approach of the ball moving toward a person attempting to catch it may be computed by multiplying the average deceleration (negative acceleration) during the act of catching the ball by the time of the action of the catch. Electronic circuitry or microprocessor can perform mathematical computations as is well known.

FIG. 1 shows a typical game ball which may use the teachings of this invention, in this case an American football. The ball 10 is equipped with instrumentation to measure the impact force during the catching of the ball in the player's hand or hands 12.

Figure 2:
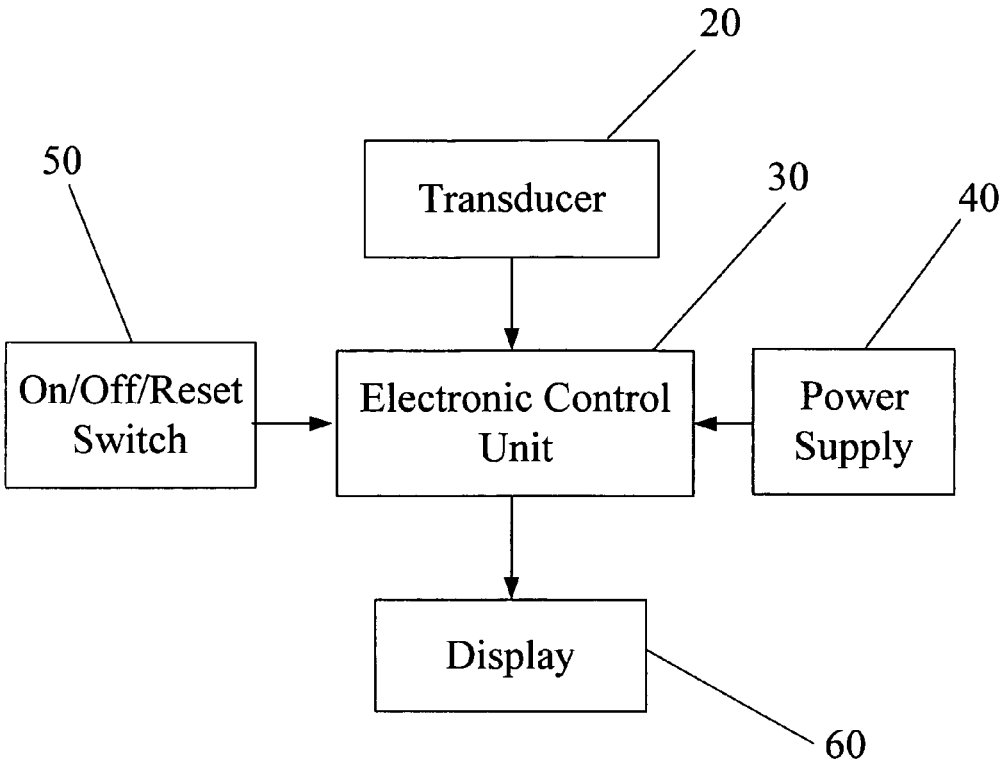
FIG. 2 shows the block diagram of the major components of one preferred embodiment.
Figure 4:
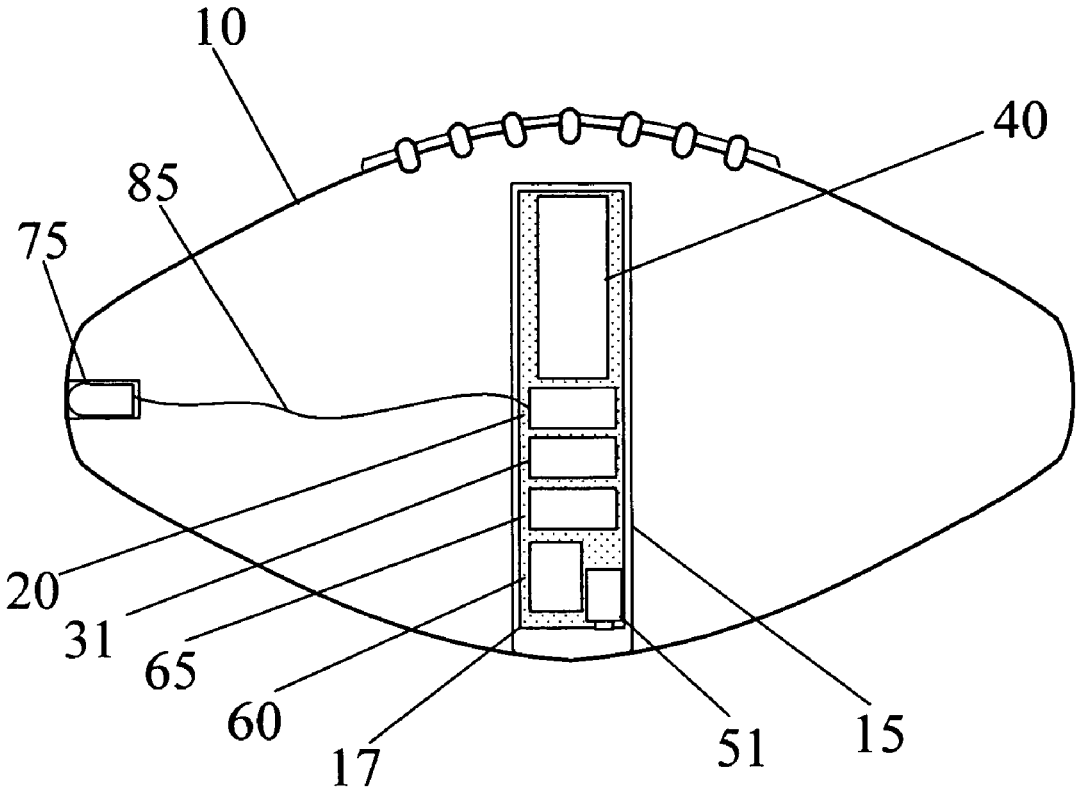
FIG. 4 shows the components of a preferred embodiment inside the game ball.
Figure 5A:
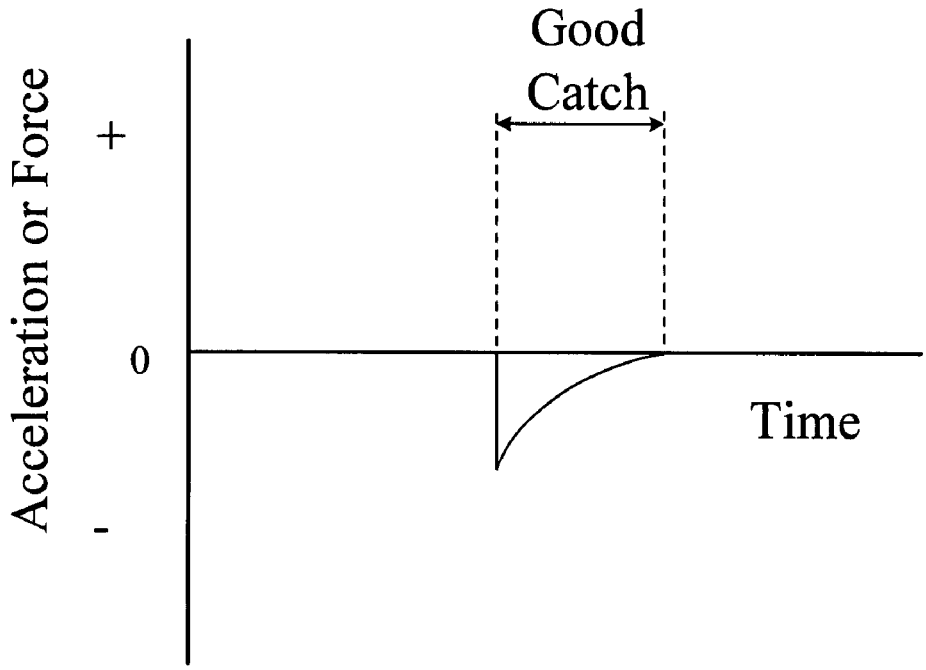
FIG. 5*a* shows an example of a graphical display of the linear acceleration or linear force on the ball during the act of a good catch.
Figure 5B:
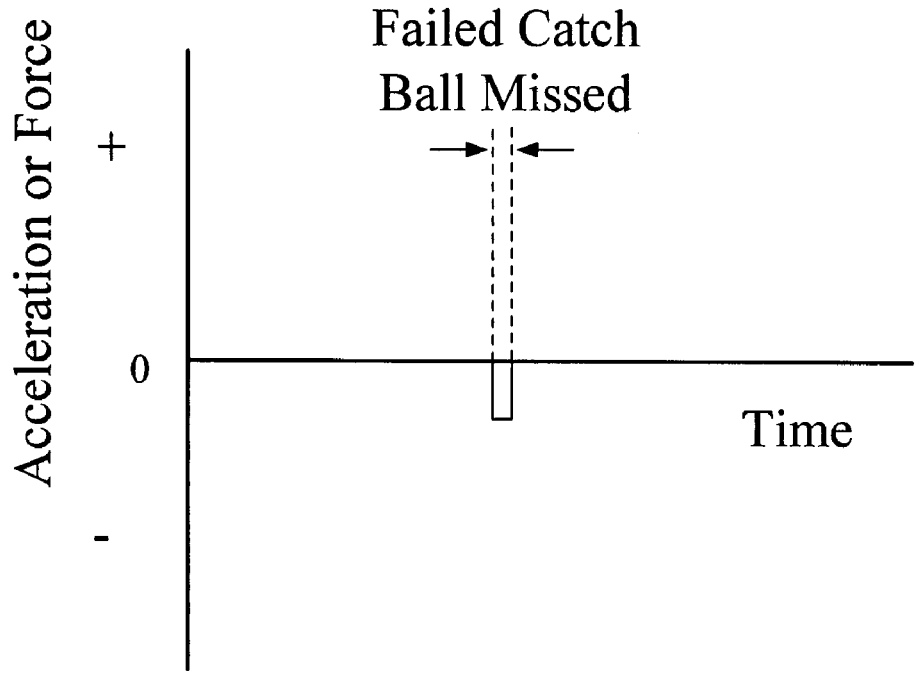
FIG. 5*b* shows an example of a graphical display of the linear acceleration or linear force on the ball during the act of a failed catch where the ball slips past the person attempting to catch the ball.
Figure 5C:
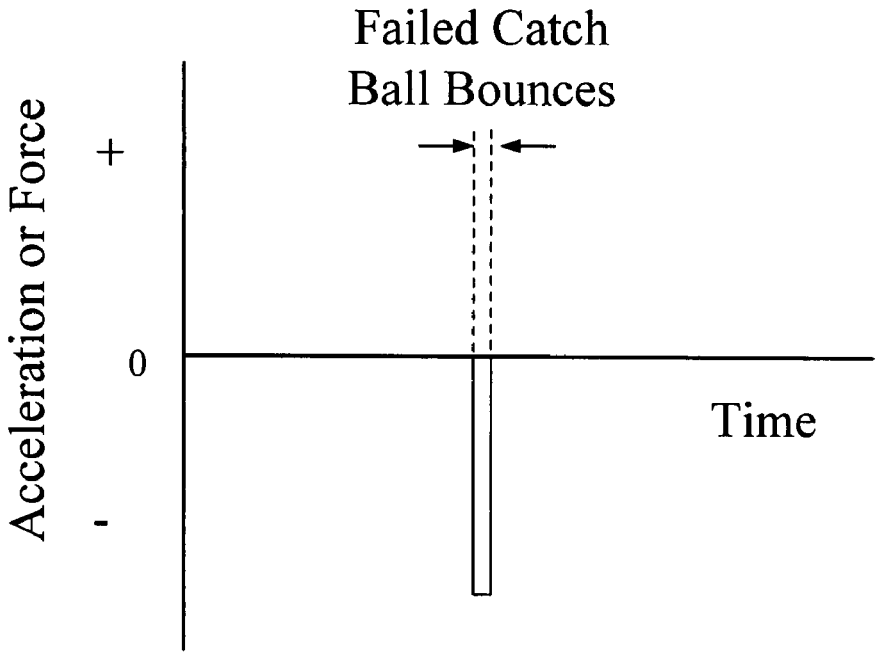
FIG. 5*c* shows an example of a graphical display of the linear acceleration or linear force on the ball during the act of a failed catch where the ball bounces away from the person.
Figure 5D:
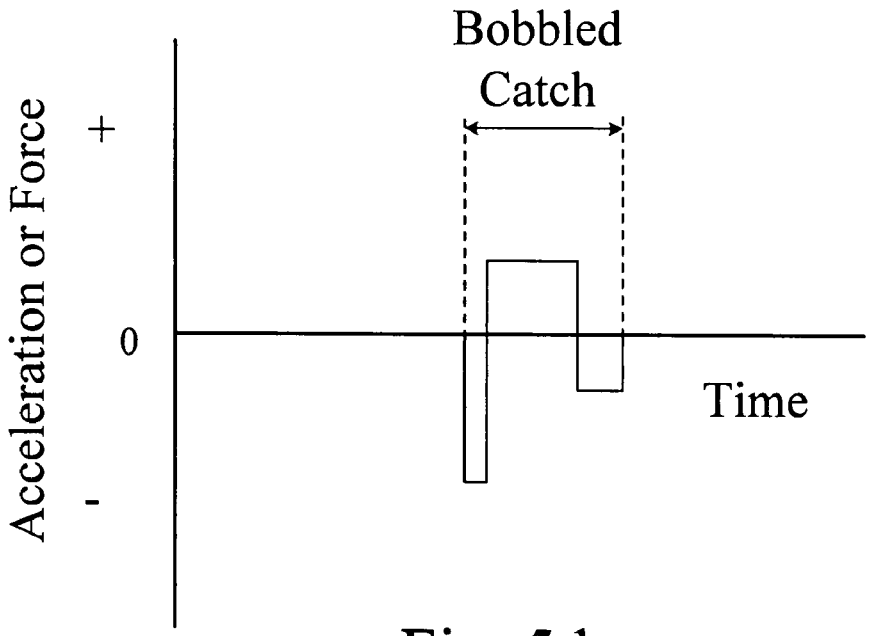
FIG. 5*d* shows an example of a graphical display of the linear acceleration or linear force on the ball during the act of a catch when the ball is bobbled.
Figure 6:
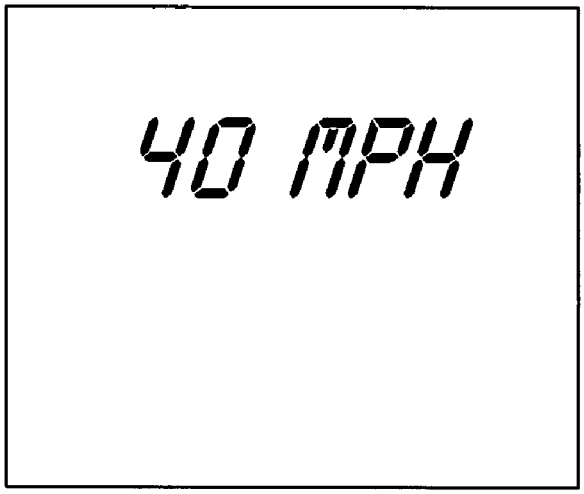
FIG. 6 shows an example of the display on the ball indicating the velocity of approach of the ball to the person attempting a catch.
Figure 7:
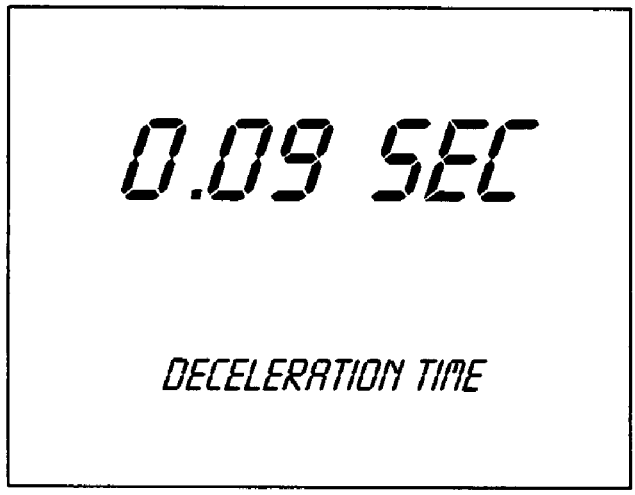
FIG. 7 shows an example of the display on the ball indicating the duration of linear deceleration of the ball during an attempted catch.
Figure 8:
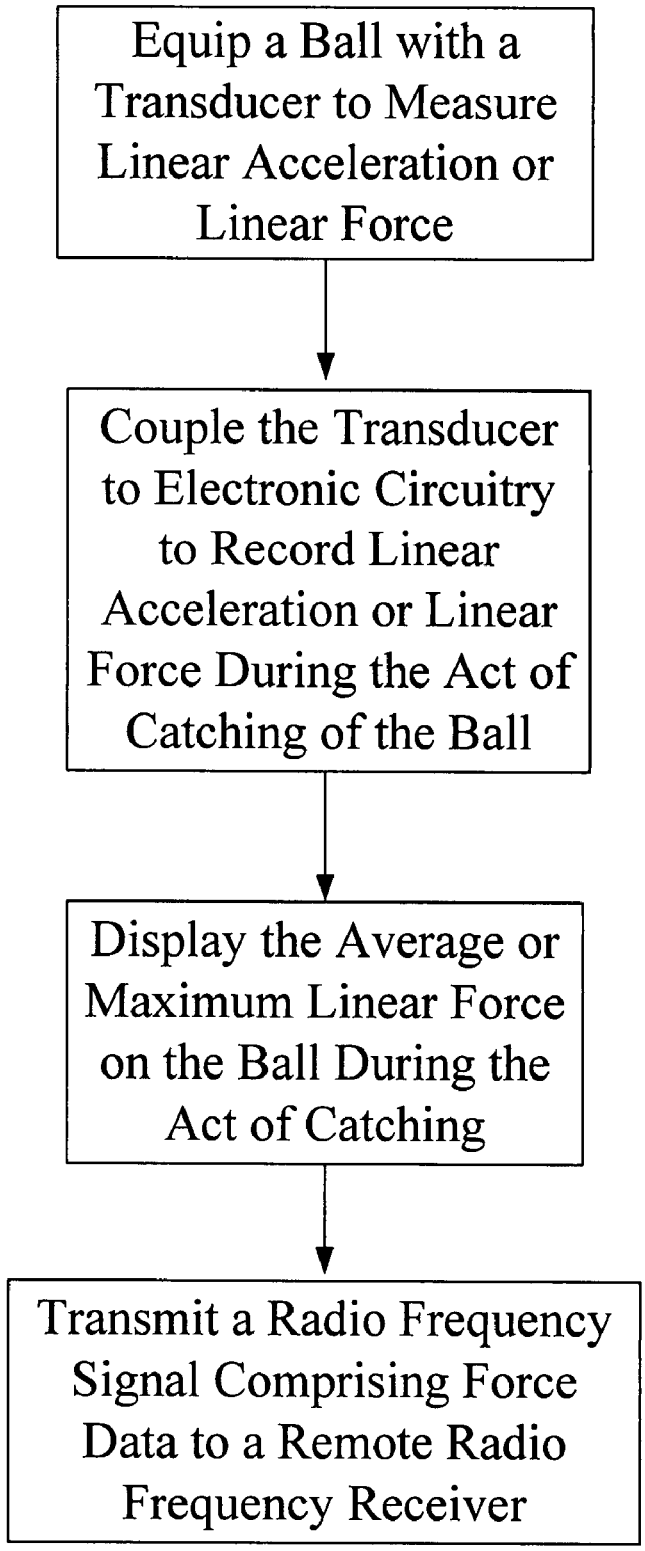
FIG. 8 shows a method of measuring at least one linear force or linear acceleration on a game ball during an act of a person catching the ball.

FIG. 2 illustrates the block diagram of the components of one embodiment of the invention. A power supply 40 provides the electrical energy to operate all of the electronic components a circuit secured in a mating plug 17 which substantially fills the interior cavity 15 of the ball 10 (FIG. 4). The mating plug 17 resides within the interior cavity 15 to provide a snug fit and prevents relative motion between the mating plug 17 and the interior cavity 15. All of the major electronic components are secured to the mating plug 17 in one preferred embodiment. The mating plug 17 may be secured inside the interior cavity 15 with any number of commonly known fastening s such as, but not limited to, hook and loop fasteners, retaining rings, screw threads, snaps, resilient clips, spring loaded tabs, twist-lock sockets, etc. The electronic control unit 30 is the central processing unit for the operation of the electrical functionality of the invention. It is noted that the electronic control unit 30, in one embodiment, is a microprocessor and may be replaced by hardwired electronic circuitry to perform similar central processing. In a first preferred embodiment, the transducer 20 is an accelerometer to sense the acceleration of the ball 10 at least during the time the ball 10 is attempted to being caught by a player and the electronic control unit 30 is a microprocessor. In another embodiment, the transducer 20 is a force transducer such as a load cell, strain gage, or other commonly used force transducer. In one embodiment, the force on the ball 10, and the resulting equal and opposite force on the hand or hands 12 of a player catching the ball 10, is determined by the electronic control unit 30 by multiplying the deceleration of the ball 10 as measured by the transducer 20 by the known mass of the ball 10. The electronic control unit 30 with an analog to digital converter, either connected or incorporated within (not shown), records the deceleration history of the ball 10 as the ball 10 is caught by the player. A timing clock function of the electronic control unit 30 is triggered when a deceleration of the ball is sensed by the transducer 20 greater than the deceleration of the ball due to aerodynamic drag. This trigger can be initiated by a discrete change in the deceleration of the ball 10 recorded by the electronic control unit 30 compared to the relatively smooth deceleration profile of the ball 10 moving as a ballistic projectile in the atmosphere. After triggering of the timing clock function, the electronic control unit 30 records the ball deceleration values at a preset data acquisition rate for a preset time, on the order of 0.25 seconds. It is noted that 0.25 seconds is only an example value and other preset times may be used. The electronic control unit 30 then signals the display 60, which is a liquid crystal display or light emitting diode display or similar known indicia display, to numerically display the average force on the ball 10, and/or the maximum force on the ball 10, and/or the duration of the catch event, and an optional graphical display of force on the ball 10 as a function of time during the attempted catch. In one embodiment, only the maximum force is displayed. In another embodiment, only the average force is displayed. In another embodiment both are displayed.

The on/off/reset switch 50 is a momentary switch which serves to turn on and off the electrical power to the components and to reset the electronic control unit 30 to perform another force measurement test. Various operational modes of a momentary switch connected to the electronic control unit 30 may be used to control the operation of the electronic functionality of the invention. In one embodiment, when the power to the electronic control unit 30 is off, depressing the on/off/reset switch 50 for approximately 2 seconds will turn on the system. When the system is on, depressing the on/off/reset switch 50 for approximately 2 seconds resets the electronic control unit 30 and the display 60 to prepare the system for the next catch attempt and resulting force measurement on the ball 10. The display 60 will indicate the mode of the system through display of indicia. When the system is on, depressing the on/off/reset switch 50 for approximately 5 seconds will turn off the system. The above mentioned times for activation of the on/off/reset switch 50 are intended to be exemplary and are in no means meant to limit the scope of the invention. The system may optionally have an auto-off mode which the electronic control unit 30 controls such that after a preset time of in activity, the system powers down as in known in many conventional electronic devices to conserve battery power. When the system is turned on or reset, the electronic control unit 30 is triggered to enter a pre-data acquisition mode as the electronic control unit 30 continuously polls the transducer 20 for a sudden change in acceleration which is indicative of the ball 10 being thrown or propelled forward. When the sudden acceleration is experienced by the transducer 20, the electronic control unit 30 enters a data acquisition mode to wait for a sudden change in the deceleration of the ball as indicated by the transducer 20, which is indicative of an attempt by a player to catch the ball 10. The action of catching the ball 10 in the player's hands 12 will take a fraction of a second for a properly executed catch.

Figure 3:
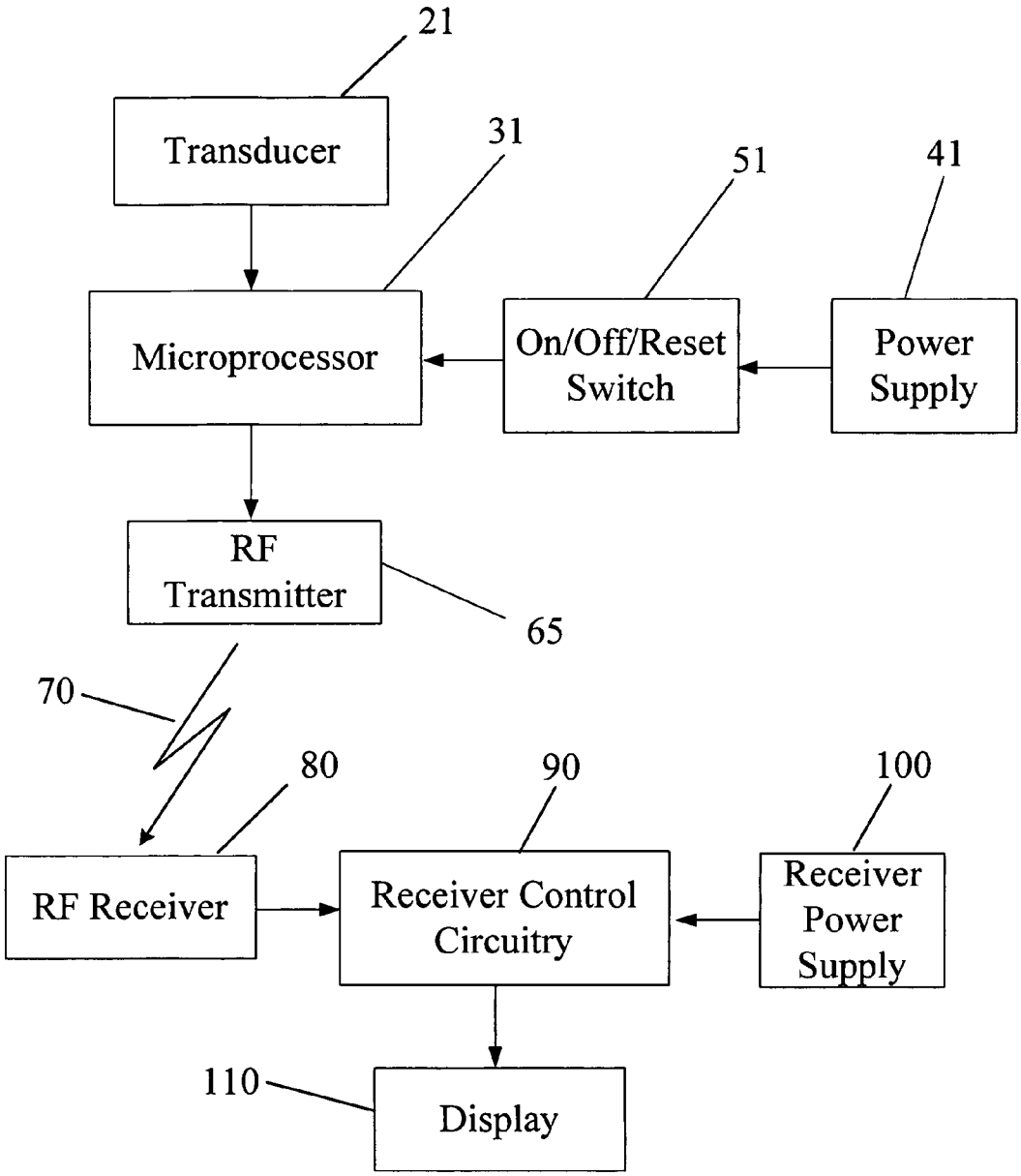
FIG. 3 shows the block diagram of the major components of a second preferred embodiment having wireless data transfer between the ball and a remote wireless receiver.

FIG. 3 illustrates the block diagram of the components a wirelessly communicating embodiment of the invention. A battery or rechargeable power supply 41 provides the electrical energy to operate all of the electronic components on a circuit secured to mating plug 17 (FIG. 4). The microprocessor 31 is the central processing unit for the operation of the electrical functionality of the invention. It is noted that the microprocessor 31, in one embodiment, may be replaced by hardwired electronic circuitry to perform similar central processing. In a preferred embodiment, the transducer 21 is an accelerometer to sense the acceleration of the ball at least during the time the ball is attempted to being caught by a player and the microprocessor 31 is a microprocessor. In another embodiment, the transducer 21 is a force transducer such as a load cell, strain gage, or other commonly used force transducer. In one embodiment, the force on the ball 10, and the resulting equal and opposite force on the hand or hands 12 of a player catching the ball 10, is determined by the microprocessor 31 by multiplying the deceleration of the ball 10 by the known mass of the ball 10. The microprocessor 31 with an analog to digital converter, either connected or incorporated within (not shown), records the deceleration history of the ball 10 as the ball 10 is caught by the player. A timing clock function of the microprocessor 31 is triggered when a deceleration of the ball is sensed by the transducer 21 greater than the deceleration of the ball due to aerodynamic drag. This trigger can be initiated by a discrete change in the deceleration of the ball 10 recorded by the microprocessor 31 compared to the smooth deceleration profile of a ball moving as a ballistic projectile in the atmosphere. The microprocessor 31 records the ball deceleration values at a preset data acquisition rate for a preset time (on the order of 0.25 seconds as one example). The microprocessor 31 then signals the radio frequency (RF) transmitter 65 to transmit data to a remote radio frequency receiver 80 through a wireless signal transmission 70. The remote radio frequency receiver 80 is connected to receiver control circuitry 90 and a receiver power supply 100. A display 110 outputs the data received by the receiver 80. The display is a liquid crystal display or light emitting diode display or similar known indicia display, to numerically display the average force on the ball 10, and/or the maximum force on the ball 10, and/or the duration of the catch event, and an optional graphical display of force on the ball 10 as a function of time during the attempted catch. In one embodiment, only the maximum force is displayed. In another embodiment, only the average force is displayed.

Another preferred embodiment of the invention includes both the radio frequency transmitter 65 and a display 60 in the ball 10 so that both the player and a remotely located trainer may view the data measured by the transducer 21.

The on/off/reset switch 51 is a momentary switch which serves to turn on and off the electrical power to the components and to reset the microprocessor 31 to perform another force measurement test. Various operational modes of a momentary switch connected to the microprocessor 31 may be used to control the operation of the electronic functionality of the invention. In one embodiment, when the power to the microprocessor 31 is off, depressing the on/off/reset switch 51 for approximately 2 seconds will turn on the system. When the system is on, depressing the on/off/reset switch 51 for approximately 2 seconds resets the microprocessor 31 and the remote display 110 to prepare the system for the next catch attempt and resulting force measurement on the ball 10. The remote display 110 will indicate the mode of the system through display of indicia. When the system is on, depressing the on/off/reset switch 51 for approximately 5 seconds will turn off the system. The above mentioned times for activation of the on/off/reset switch 50 are intended to be exemplary and are in no means meant to limit the scope of the invention. The system may optionally have an auto-off mode which the microprocessor 31 controls such that after a preset time of in activity, the system powers down as in known in many conventional electronic devices to conserve battery power. When the system is turned on or reset, the microprocessor 31 is triggered to enter a pre-data acquisition mode as the microprocessor 31 continuously polls the transducer 21 for a sudden change in acceleration which is indicative of the ball 10 being thrown or propelled forward. When the sudden acceleration is experienced by the transducer 21, the microprocessor 31 enters a data acquisition mode to wait for a sudden change in the deceleration of the ball 10 as indicated by the transducer 21, which is indicative of an attempt by a player to catch the ball 10. The action of catching the ball 10 in the player's hands 12 will take a fraction of a second for a properly executed catch.

As is shown in FIG. 4, the electronic components are fixed to at least one circuit board fixed to a mating plug 17 secured within an interior cavity 15 in one embodiment. The interior cavity 15 extends to at least one exterior surface of the ball 10 so that the cavity 15 is accessible to a person from the exterior of the ball 10. It is noted that the interior cavity 15 is shown in FIG. 4 as oriented perpendicular to the longitudinal axis of the ball 10, however, in other embodiments of the invention, the interior cavity may be oriented differently and still be within the intended scope of the invention.

The mating plug 17 secures the transducer 20, 21 microprocessor 31 (or equivalent hardwired circuit), an optional radio frequency transmitter 65, and an optional display 60. An optional counter-balance weight (not shown) may be inserted into the internal cavity 15 of the ball 10 to provide gravimetric and/or dynamic balance for the ball 10.

An illumination source such as the tip of a high intensity light emitted diode 75 is positioned on the outer surface of the ball 10 in one embodiment. The light emitting diode 75 is connected to the microprocessor 31 via an electrical conductor 85 and is pulsed to flash at a set periodicity by the microprocessor 31. In one embodiment, the color of the light emitting diode may change with time by varying the supplied electrical parameters such as but not limited to voltage level, polarity, and frequency. This light emitting diode is used to assist the player to maintain focus on the ball 10 as it approaches.

It is understood that the output data indicated on the display 60, 110 may be force data, deceleration data, or time data associated with the event of catching the ball 10 in order to serve as a metric for training a player on how to properly and consistently catch the ball 10.

All of the embodiments of the invention described herein are exemplary and are not intended in any way to limit the scope of the invention or its appended claims. Modifications of the teachings herein will become obvious to those skilled in the art and such modifications are intended to fall within the scope if this invention. It is noted that the drawings present herein are for an American football, but the teachings are applicable to other game balls intended to be caught in the hand or hands of a player of a game. It is also noted that the term "attempted catch" or similar wording used herein means that a person is making a conscious effort to catch a ball moving toward him or her using his or her hand or hands, and the catch may or may not be successful.

What is claimed:

1. A sports apparatus comprising:

a game ball having an interior cavity extending to at least one outer surface of the ball;

electronic control circuitry secured within the interior cavity;

a transducer coupled to the electronic control circuitry and secured within the interior cavity such that linear deceleration of the ball is measured by the transducer and recorded by the control circuitry after a discrete change in linear deceleration is sensed by the transducer compared to the atmospheric projectile motion of the ball thereby indicating an attempted catch of the ball by a person;

linear decleration of the ball is measured during the attempted catch of the ball by a person; and a display coupled to the control circuitry within the internal cavity such that the display is visible to a human holding the ball after the attempted catch.

2. The apparatus of claim 1 wherein the display indicates a maximum force on the ball during an attempted catch of the ball by the person.

3. The apparatus of claim 1 wherein the display numerically indicates an average force measured on the ball during an attempted catch of the ball by the person.

4. The apparatus of claim 1 wherein the display indicates a graphical representation of force on the ball as a function of time during an attempted catch of the ball by the person.

5. The apparatus of claim 1 wherein the display indicates, after an attempted catch of the ball, velocity of the ball as the ball approaches a person attempting to catch the ball.

6. The apparatus of claim 1 wherein the display indicates duration of the deceleration of the ball during an attempted catch of the ball by a person.

7. The apparatus of claim 1 further comprising at least one illumination source fixed to the ball.

8. The illumination source of claim 7 comprises a flashing, light emitting diode.

9. The apparatus of claim 1 wherein the control circuitry computes force on the ball due to deceleration of the ball as the ball is attempted to be caught by a person.

10. The apparatus of claim 1 wherein the transducer is an accelerometer.

11. A sports apparatus comprising:

a game ball having an interior cavity extending to at least one outer surface of the ball;

electronic control circuitry secured within the interior cavity;

a transducer coupled to the electronic control circuitry and secured within the interior cavity such that a linear force on the ball is measured by the transducer at least during a time when the ball is attempted to be caught by a person;

a battery power supply connected to the control circuitry;

a wireless radio frequency transmitter coupled to the control circuitry such that data measured by the transducer are transmitted to a remotely located radio frequency receiver; and a display coupled to the receiver to visually indicate the data measured by the transducer.

12. The apparatus of claim 11 wherein the display numerically indicates a maximum force measured by the transducer during an attempted catch of the ball by the person.

13. The apparatus of claim 11 wherein the display indicates an average force measured by the transducer during an attempted catch of the ball by the person.

14. The apparatus of claim 11 wherein the display indicates velocity of the ball, the value of which is calculated by the electronic circuitry, as the ball approaches a person attempting to catch the ball.

15. The apparatus of claim 11 wherein the display indicates duration of forces experienced by the ball during an attempted catch of the ball by a person.

16. The apparatus of claim 11 further comprising at least one illumination source fixed to the ball.

17. The illumination source of claim 16 comprises a flashing, light emitting diode.

18. The apparatus of claim 11 wherein the transducer is a force transducer.

19. A method of measuring at least one force on a game ball during an act of a person catching the ball comprising:

equipping the ball with a transducer to measure at least one of linear deceleration on the ball and linear force on the ball;

coupling electronic circuitry to the transducer to record at least one of linear deceleration on the ball and linear force on the ball during the act of catching the ball by a person; and displaying at least one of an average linear force on the ball and a maximum linear force on the ball as measured by the transducer during the act of a person catching the ball.

20. The method of claim 19 further comprising:

transmitting a radio frequency signal to a remote radio frequency receiver, said signal comprising force data as measured by the transducer.

* * * * *